US006335710B1

(12) United States Patent
Falk et al.

(10) Patent No.: US 6,335,710 B1
(45) Date of Patent: Jan. 1, 2002

(54) TUNEABLE SPIRAL ANTENNA

(75) Inventors: Kent Falk, Mölnlycke; Ingmar Karlsson, Kållered, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/594,769

(22) Filed: Jun. 16, 2000

(30) Foreign Application Priority Data

Jun. 18, 1999 (SE) ..... 9902337-6

(51) Int. Cl.[7] ..... H01Q 15/02
(52) U.S. Cl. ..... 343/895; 343/753
(58) Field of Search ..... 343/895, 909, 343/753, 911 R; 333/161; 505/210

(56) References Cited

U.S. PATENT DOCUMENTS

| | | | | |
|---|---|---|---|---|
| 3,820,117 A | | 6/1974 | Hall et al. | 343/802 |
| 5,589,842 A | | 12/1996 | Wang et al. | 343/787 |
| 5,589,845 A | | 12/1996 | Yandrofski et al. | 343/909 |
| 5,631,659 A | * | 5/1997 | Evans et al. | 343/700 MS |
| 5,679,624 A | | 10/1997 | Das | 505/210 |
| 5,970,393 A | * | 10/1999 | Khorrami et al. | 455/66 |

FOREIGN PATENT DOCUMENTS

| | | |
|---|---|---|
| JP | 06268434 | 9/1994 |

OTHER PUBLICATIONS

PCT International–Type Search Report No. SE 99/00864.

* cited by examiner

*Primary Examiner*—Don Wong
*Assistant Examiner*—James Clinger
(74) *Attorney, Agent, or Firm*—Burns, Doane, Swecker & Mathis, L.L.P.

(57) ABSTRACT

The invention sets forth an aerial (1) having at least one plane spiral arm (3*a* . . . 3*d*) being provided in front of and parallel with a plane face of a reflecting member (4), the aerial furthermore having a ferro-electric member (2) arranged between the at least one spiral arm (3*a* . . . 3*d*) and the reflecting member (4). An interface circuit provides an adjustable bias voltage over the at least one arm (3*a* . . . 3*d*) and the reflecting member (4) for varying the dielectric constant of, and thereby the delay through, the ferro-electric member (2). In this manner, the aerial is tuned to various frequencies of interest and providing for an enhanced antenna gain. According to a further aspect of the invention an interface circuit provides individually controllable bias voltages to respective spiral arms for accomplishing tuning of the axial ratio and/or impedance match of the aerial.

12 Claims, 8 Drawing Sheets

A - A

B - B

C - C

TUNEABLE SPIRAL ANTENNA

FIELD OF THE INVENTION

The present invention concerns a tuneable spiral antenna.

BACKGROUND OF THE INVENTION

Spiral antennas are used for transmitting and/or receiving circularly polarised electro-magnetic waves.

The good wideband properties of spiral antennas make them suitable for broadband applications such as mobile phones, radar systems and signal surveillance systems. An example of a spiral antenna for radar use is known from U.S. Pat. No. 3,820,117.

The directivity pattern of a non-shielded plane spiral antenna can be described as having two opposite lobes extending from the centre of the spiral and being perpendicular to the plane of the spiral.

In order to enhance the directional characteristic of the spiral antenna, it is known that the spiral antenna can be mounted in an open cavity, such as a tube. Closing the cavity at the rear end by a ground plate implies that the antenna gains about 3 dB in sensitivity.

However, this solution is afflicted with a bandwidth reduction, because the reflection from the ground plate is only within a certain limited frequency range in phase with the radiation from the spiral element as compared to an open cavity design.

Prior art document JP-A-06268434 (published Sep. 22, 1994) shows a spiral antenna for the emission and/or reception of circularly polarised waves. The spiral antenna has a pattern of two spiralling arms, which are arranged in front of a reflective cone.

For aerials having a similar structure to the device according to JP-A-06268434, a dielectric material having a certain dielectric coefficient may be arranged between the spiral arms and the reflective cone. Such an aerial design allows for a transmission enhancement within a certain larger frequency band. For each frequency there is a resonance, which corresponds to the diameter on the spiral formed aerial. The top angle of the cone is chosen such that for any given frequency in the band and corresponding position on the spiral, the electrical distance through the material, which may be disposed between the aerial and the reflective cone, always corresponds to a quarter of the wavelength of this given frequency. Thereby, it is intended that waves being reflected from the reflective cone are always impinging on the rear side of the aerial with a phase value corresponding to the phase value of the direct wave.

Unfortunately, the radiation from the aerial is not impinging orthogonally on the cone but at an angle, whereby waves are directed against the tubular housing. This has a limiting effect on the efficiency of the aerial.

From prior art document U.S. Pat. No. 5,589,845, frequency tuneable microwave devices, which comprises structures of super-conducting thin films and ferro-electric films are known.

In the above document, various devices utilising ferro-electric materials have been discussed, such as delay lines, phase shifters, resonators, filters, electrically small antennas, half loop antennas and patch antennas. According to this document, a bias voltage is applied over the ferro-electric material, such that the delay of electrical waves propagating through the material can be controlled. Specifically, U.S. Pat. No. 5 589 845 discloses a phase array antenna (FIG. 7) comprising antenna elements coupled to ferro-electric thin film phase shifters. The dielectric permitivity of the respective phase shifter is controlled individually by providing a suitable DC bias voltage over the respective phase shifters. In this way, an angularly steerable beam is achieved.

SUMMARY OF THE INVENTION

One object of the present invention is to set forth a spiral antenna, which provides for an enhanced antenna gain and a better control of the element performance over a wide bandwidth.

This object has been achieved by the subject matter defined in independent claim 1.

According to the invention, the dielectric constant of the ferro-electric material is altered for controlling the phase of the reflected wave as well as the radius at which the spiral radiates (i.e. the size of the element). The possibility to control the element performance is useful both when using the element alone and when using several elements in clusters to compensate for changing impedances due to scanning and frequency hops.

It is another object to provide an aerial element in which the axial ratio of the polarisation can be varied and in which the impedance match to an external transceiver may also be varied.

This object has been accomplished by the subject matter set forth in claim 10.

The possibility to feed the different spiral arms with different bias voltages adds to the freedom of controlling the element performance.

Further advantages will appear from the detailed description following below.

DETAILED DESCRIPTION OF A PREFERRED EMBODIMENT OF THE INVENTION

Two Arm—Common Feed

The structure of a preferred embodiment of the aerial according to the invention shall now be explained with reference to FIGS. 1–4.

Figure 1:
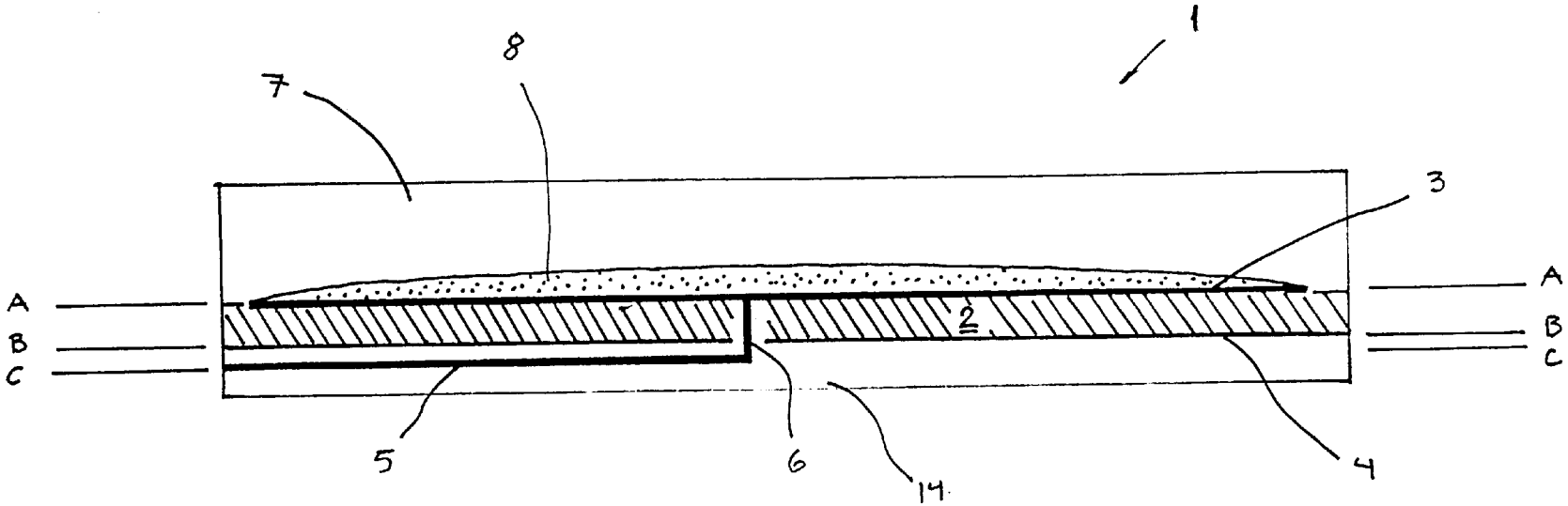
FIG. 1 shows a cross section of a first embodiment of the aerial according to the invention.
Figure 2:
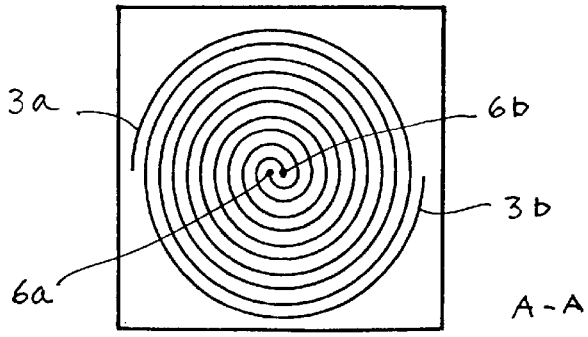
FIG. 2 is a plane view along line A—A in FIG. 1, showing a spiral.
Figure 3:
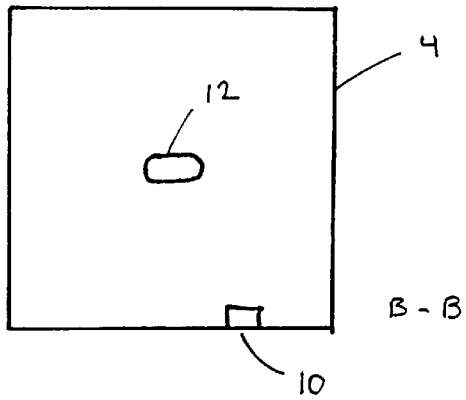
FIG. 3 is a plane view along line B—B in FIG. 1, showing a reflecting member.
Figure 4:
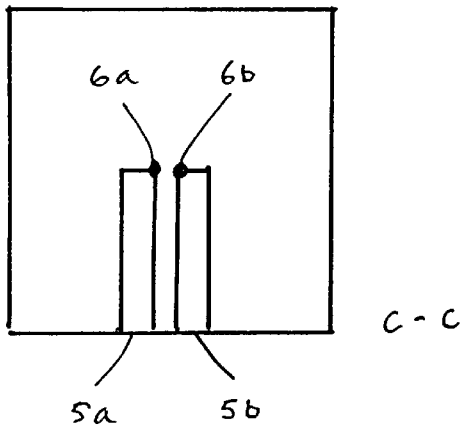
FIG. 4 is a plane view along line C—C in FIG. 1, showing a strip network

The aerial according to the present invention comprises at least one arm having the shape of a spiral. Advantageously the spiral may be shaped as an Archimedes spiral as shown in FIG. 4 or any other spiral shape such as the spiral shapes discussed below.

According to the embodiment shown in FIGS. 1–4, the spiral 3 has a first arm 3*a* and second arm 3*b* having a shape as an Archimedes spiral, whereby the arms are being arranged in a plane with a fixed distance between them. The arms are provided with conducting vias 6*a* and 6*b* at their inner ends, which are disposed orthogonally with respect to the plane of the arms. Both the arms and the vias are electrically conductive. The vias are advantageously disposed parallel at a certain distance from one another.

The first and second arms are intertwined such as not to contact one another and arranged with the outer end portions of the arms arranged diametrically to the centre portion of the spiral. The spiral shaped arms are arranged parallel with and at a certain distance from a plane top surface of a reflecting member 4.

The reflecting member 4, also made of a conductive material, is provided with an aperture 12 in the centre thereof allowing the vias 6*a* and 6*b* to extend through it. The plane surface of the reflecting member 4 allows for an orthogonal reflection of waves, which contributes to an enhanced efficiency of the aerial.

Between the spiralling arms 3*a*, and 3*b* and the reflecting member 4 there is provided a ferro-electric member 2 having preferably homogenous dielectric properties.

At the other side of the reflecting member 4, there is provided a laminate 14. The laminate 14 comprises a strip network 5 having two conductive strips 5*a* and 5*b* being arranged at a certain distance from the surface of the reflecting member 4. The strips 5*a* and 5*b* are connected to vias 6*a* and 6*b* respectively. The reflecting member 4 also acts as ground plane for the conductive strips in the laminate.

The ground-plane/reflecting surface is removed around the vias connecting the respective strip and the respective spiral.

The strip network 5, the aperture 12 and the laminate 14 form the feed for the spiral arms and these elements are therefore dimensioned to match one another in respect of impedances and RF emission properties.

In front of the spiral arms 3*a* and 3*b*, there is arranged a front member 8 having a high dielectric constant and being shaped like a cone or a cup. The front member 8 is arranged with its thickest portion over the central portion of the spiral. Over the front member 8, there is arranged a wideband transformer structure 7.

The front member 8 and the transformer structure 7 serves to match the aerial to the surrounding medium of the aerial such as air or free space. At low frequencies, the spiral is small compared to the free space wavelength. Therefore, the purpose of the front member 8 and the transformer structure 7 is to increase the radiating area of the spiral to get a better match to the surrounding field.

The transformer can be realised as a multi-layer structure with different dielectric constants in the layers or with a gradually varying dielectric constant. For ferro-electric materials with a high dielectric constant, a highly dielectric material close to the spiral arms improves the match to free space.

The front member 8 is constructed from a homogenous dielectric material with a dielectric constant matching the ferro-electric member 2.

An ideal transformer design would comprise a material having a dielectric constant that changes from the high dielectric constant of the ferro-electric material to the lower dielectric constant of the air, for example. Composing the transformer of several layers with gradually increasing dielectric constants is one way of accomplishing a structure, which would have properties close to such an ideal transformer. A transformer having alternating dielectric layers could also be tailored to a specific frequency profile.

For large-scale production, the front member 8 and the transformer structure 7 may be integrated and for array antennas, they are preferably made of sheets of material having the same size as the array.

Figure 5:
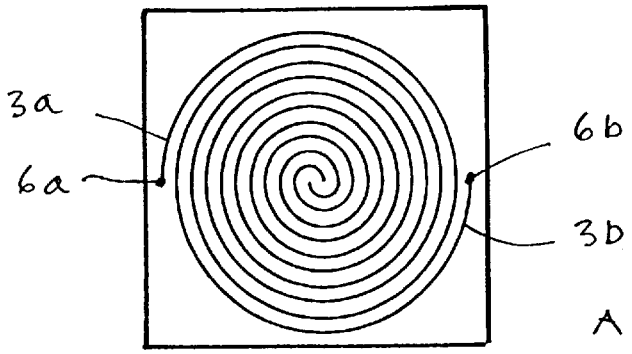
FIGS. 5, 6 and 7 shows an alternative embodiment.
Figure 6:
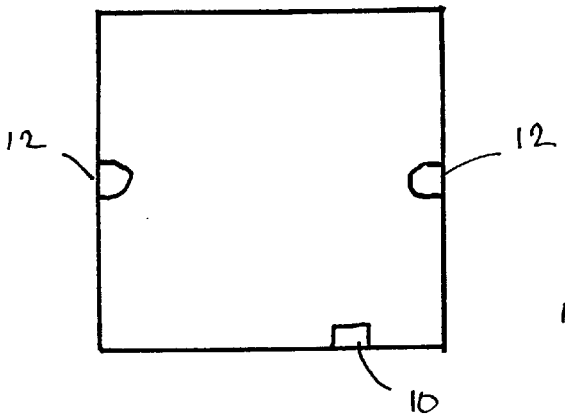
Figure 7:
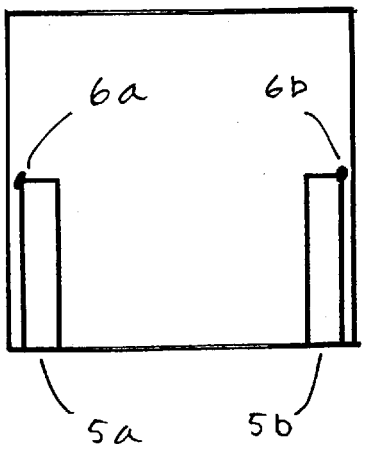

In FIGS. 5–7 an alternative embodiment to the aerial shown in FIGS. 1–4 have been shown. This embodiment concerns an alternative way of feeding the spiral element, namely by feeding the spiral arms 3*a* and 3*b* from the perimeter. For this purpose, two apertures 12 are arranged at corresponding positions at the perimeter of the spiral arms.

As no central aperture is provided in the above alternative embodiment, the spiral is able to work also in the innermost area, thereby enabling a particular high operating band width.

Figure 9:
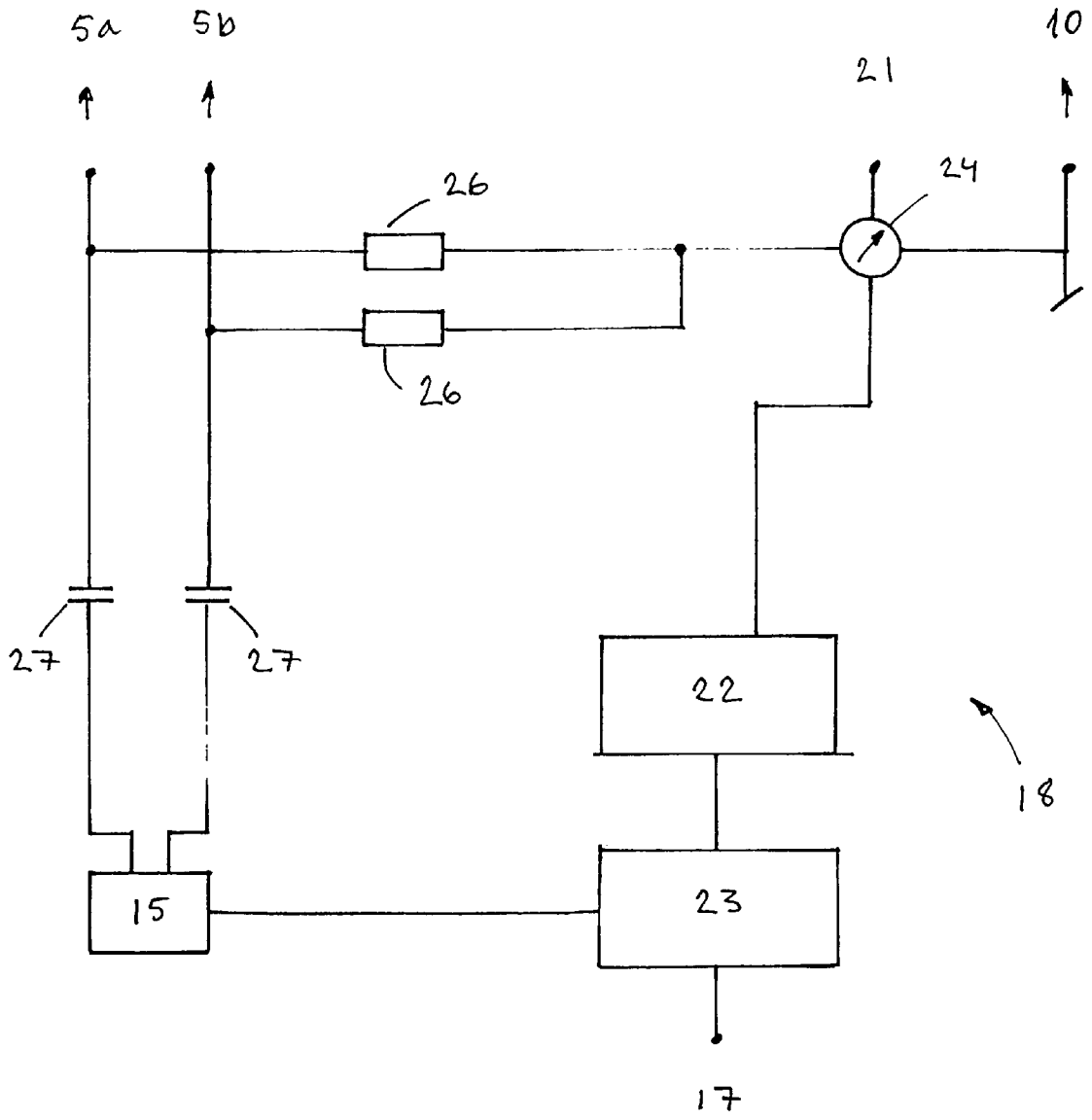
FIG. 9 shows a first interface circuit for feeding a two arm spiral aerial as shown in FIGS. 1–7.

In FIG. 9, a first interface circuit 18 for being coupled to the above-mentioned aerial structures has been shown.

The first interface circuit 18 comprises a DC bias source 21 and a variable first DC bias voltage regulator 24 adjustable over an input terminal. One terminal of the first bias voltage regulator 24 is coupled through respective inductors 26 to the terminals of the strips 5*a* and 5*b*. The other terminal of the DC source is coupled to a terminal 10 on the reflecting member 4.

The controllable DC source supplies a bias voltage over first and second arms 3*a* and 3*b* and the reflecting member 4 for varying the dielectric constant of, and thereby the delay through, the ferro-electric member 2. In this manner, the aerial can be electrically controlled to be optimised for a given frequency band or a plurality of frequency bands over time.

An input/output signal is fed to, or derived from, a terminal 17 of a transceiver 23, which leads an antenna signal to and/or from the unbalanced port of a balun 15. Balun 15 has further two balanced ports, which are connected through capacitors 27 to the respective arms 2*a* and 2*b* through the respective strips 5*a* and 5*b*. Balun 15 performs a conversion from an unbalanced signal to a balanced signal. The transceiver 23 has a reference oscillator by which the carrier frequency of the signal can be tuned in a known way. The first interface circuit 18 is designed to handle high voltages but hardly any currents.

The first interface circuit 18 comprises moreover a control unit 22, which controls the frequency tuning of the transceiver 23 and the first bias voltage regulator 24. The control unit is adapted to be coupled to an interface module (not shown) by which instructions can be received.

The function of the aerial according to the invention, as it is performed under the control of the control unit 22, shall now be explained in more detail.

For the non-enclosed spiral antenna, i.e. the above aerial without the reflecting member, positive signal interference occurs at a ring shaped area on the spiral antenna being defined by a radius corresponding to a certain frequency. For a low frequency signal, positive interference occurs at an area on the spiral arms being defined by a relatively high radius. For a high frequency signal, positive interference occurs at an area being defined by a smaller radius.

A given bias voltage will produce a given delay through the ferro-electric material. This means, that for certain combinations of frequency and bias voltage, the reflected wave from the reflecting member 4 will be in phase with the direct wave being received on or being emitted from the spiral arms 3*a* and 3*b*. This effect applies both when the aerial is functioning as an emitting antenna as well as a receiving antenna.

According to the invention, the bias voltage, and hence the delay through the material, is advantageously chosen to match the frequency of interest. Different frequencies of interest, i.e. a certain bandwidth, may be utilised by sweeping the bias voltage correspondingly over time.

Figure 8:
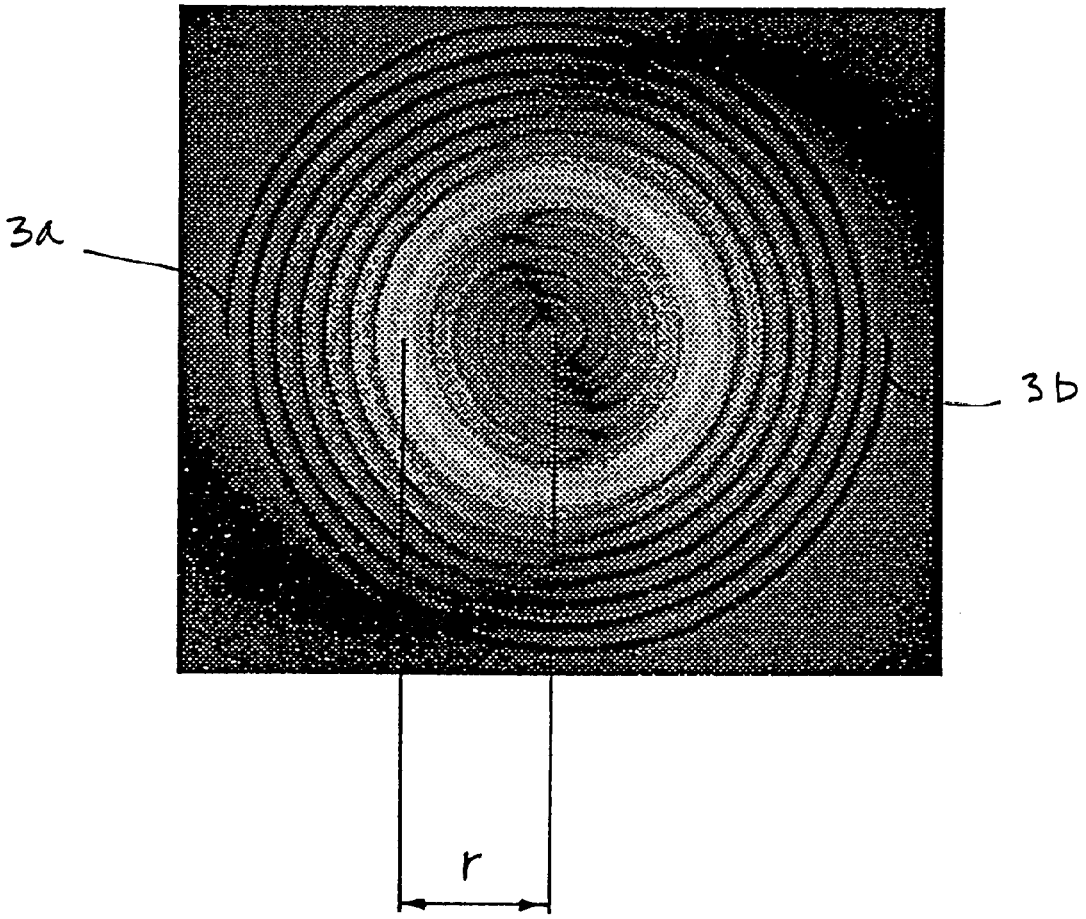
FIG. 8 shows a computer simulation of a structure similar to the embodiment shown in FIG. 1.

FIG. 8 represents a computer simulation of a spiral functioning as an emitting antenna. A signal having a certain relative narrow frequency content was simulated being fed to an antenna structure similar to the embodiment shown in FIG. 1. The grey scale values in FIG. 8 represent the signal power values in the antenna structure, whereby light colours represent high signal power values. It is seen that the aerial is emitting at the radius r.

Apart from varying the bias voltage, the tuneable frequency band is determined by tuning the reference oscillator in the transceiver 23.

An important advantage of the invention is the possibility to control the match and radiation properties over a wide frequency range. Altering the dielectric constant of the ferroelectric material controls the phase of the reflected wave as well as the radius at which the spiral radiates (i.e. the size of the element). These possibilities to control the element performance are useful both when using the element alone and when several aerial elements of the above shown embodiments are used in an array to compensate for changing impedances under scanning and frequency hops.

Regarding the manufacture of the above aerial, the ferroelectric member 2 may be constituted by a thin film or a ceramic material. In the present example, a 1 mm thick ceramic bulk material is used. Examples of typical such materials are barium titanate, barium strontium titanate or lead titanate in fine grained random polycrystalline or ceramic form.

A suitable ceramic material is for instance made available on the market by Paratek® Inc., Aberdeen, Md., USA and is denoted as composition 4. This material presents a relative permittivity of 118 at zero DC field and has a tuning range of 10% according to the specification. The dielectric constant and tuning range of the ferro-electric material can be chosen from standard materials or can be specially composed. Relative permittivity values between 80–1500 are available and the tuning range varies from about 2%–50%. Losses and the voltage required for tuning are also important parameters when selecting the material Ordinary processes for making ceramic materials and processing circuit boards and substrates can be used in the manufacturing of the aerial.

The spiral pattern may for example be printed on the ferro-electric member and the vias may be constituted by holes, which are drilled and metallised. The ground plane may also be printed directly on the ferro-electric member in order to reduce the risk of any air gaps appearing, because such air gaps would have a negative impact on the control of the field strength. A circuit board with the first and second strips and auxiliary circuits (not shown) may be glued to the ground plane. The multi-layer transformer may be baked or glued together and then glued on top of the spiral.

Two Arm—Common Feed in Array

The aerial set forth above may—as already indicated above—form the individual elements in a group antenna, whereby sub-groups of one or more individual elements are controlled according to desired directivity characteristics, by controlling the bias voltage for the individual sub-groups.

The simplicity of the above-described aerial structure makes it very useful as an element in an array structure. Moreover, the possibilities to control the performance of individual elements by applying respective changing bias voltages are particular useful for compensating for changing impedance, which typically appear in group antennas under scanning and frequency hops.

SECOND EMBODIMENT OF THE INVENTION

Two Arm—Individual Feed

According to a second embodiment of the invention, a two-arm spiral antenna structure as shown in FIGS. 1–4 or 5–7, is provided with individual bias voltages.

Figure 10:
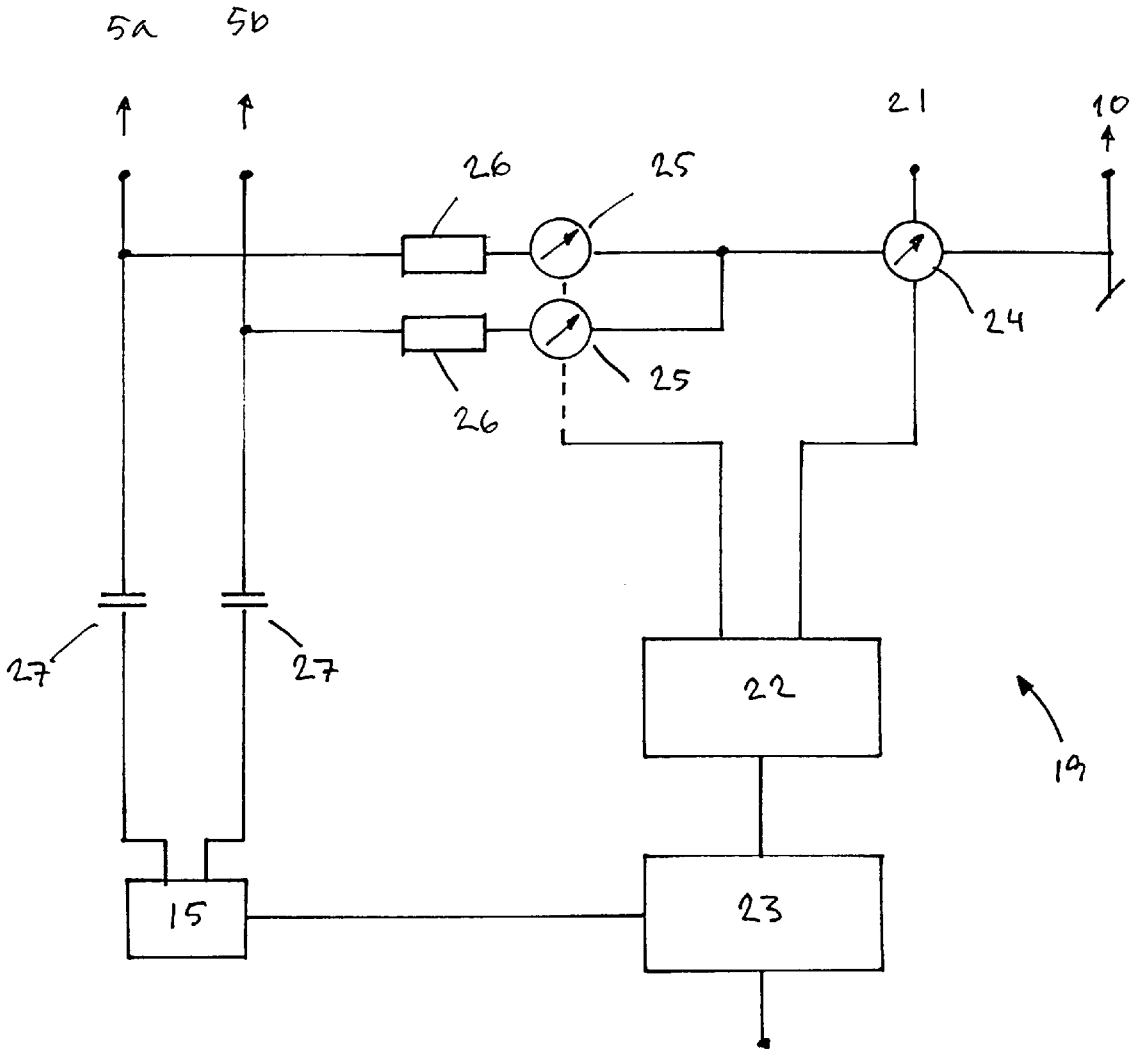
FIG. 10 shows a second interface circuit for feeding a two arm spiral aerial as shown in FIGS. 1–7.

A second interface circuit 19, shown in FIG. 10, comprises—in addition to what has been disclosed in the above mentioned interface circuit—two second bias voltage regulators 25 being controlled by control unit 22 and being adapted for controlling the bias voltages fed to the individual arms, 3*a* and 3*b*, in the aerial.

The possibility to feed the different spiral arms with different bias voltages offers two main advantages compared to the above singularly fed spiral antenna. One advantage is the freedom to modify the axial ratio enabling for example a good circular polarisation at desired aspect angels.

The axial ratio is the ratio between the scalar values of the E-field and the H-field, which for circular polarised fields are rotating with a phase value of 90° between them.

The field strength in a given point in space can be described by the axial ratio. For an ideal (fully symmetrical) spiral antenna, the emission on a central axis, being perpendicular to the spiral antenna and going through the centre will have an axial ratio of 1, i.e. a circular polarisation. In other points, i.e. at particular aspect angles, the axial ratio will differ from 1; i.e. the field will attain an elipsoidical polarisation.

The cross-polar component of a spiral antenna is often generated by reflections from the end of the spiral arm. Very small changes in the propagation along the arm affect the phasing of the reflected and the direct wave and may affect the axial ratio in a given point or given aspect ratio.

According to the invention, the above changes in the propagation properties can be produced by varying the bias voltage thus rendering it possible to modify the axial ratio in order to meet given requirements at certain aspect angels.

Another advantage by providing independent bias voltages to the respective arms is the possibility to optimise the impedance match of the element to the transceiver. This is particularly useful when the element is used in a scanning array where the mutual coupling makes the impedance change as the array is scanned. In such an array, the modification of the phases between the reflections on the arms can be used to actively to improve the element match to the transceiver.

THIRD EMBODIMENT

Four Arm—Individual Feed/Common Feed

According to a third embodiment of the invention, the aerial comprises four arms. Apart from this, the aerial structure is similar to the above structures and it may be manufactured in a similar way.

A four-arm spiral has better polarisation properties than a two-arm spiral but the feed circuits are inherently more complex.

Figure 12:
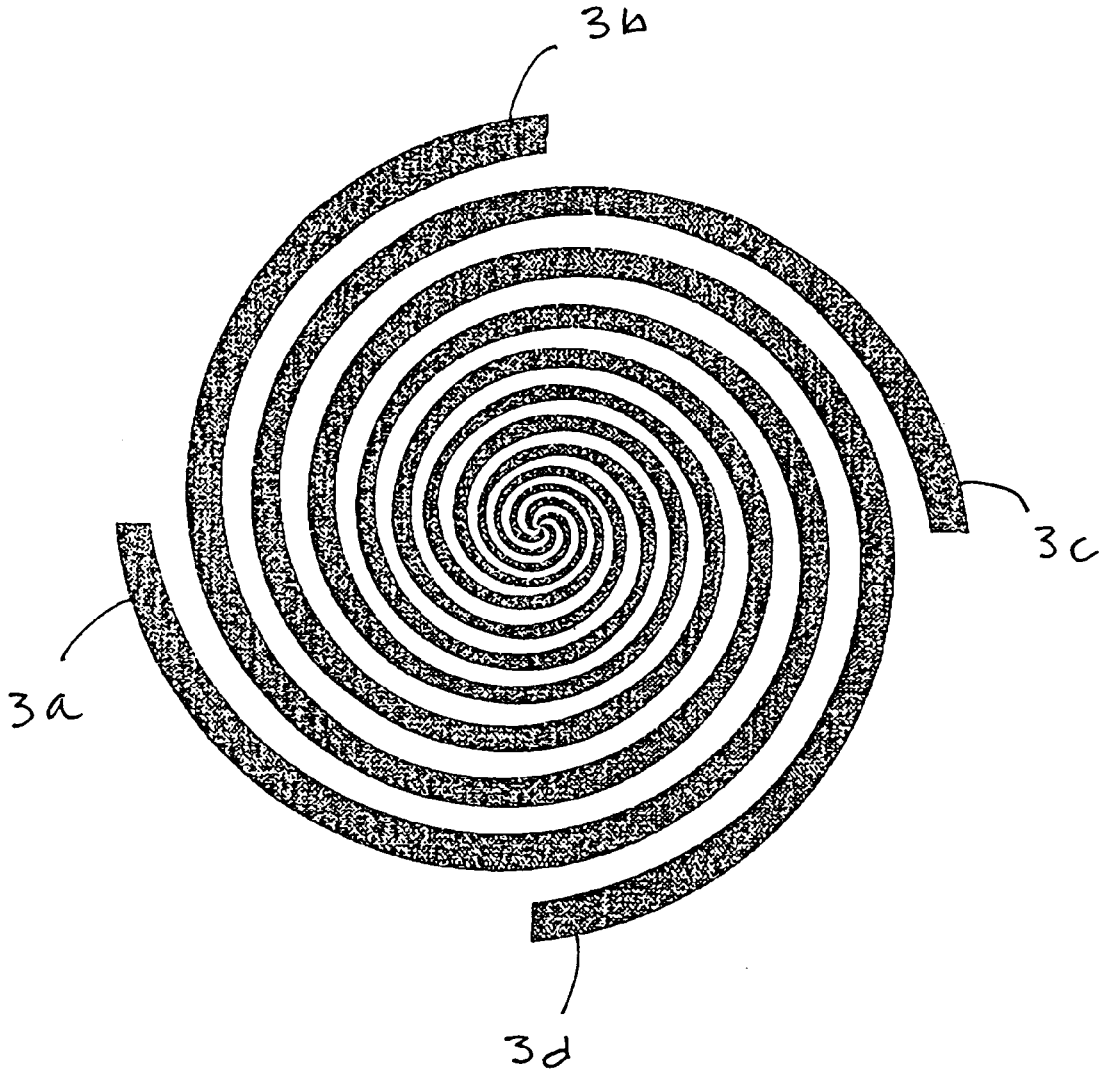
FIG. 12 shows a four-arm spiral.

The spiral pattern may be shaped as shown in FIG. 12.

Figure 11:
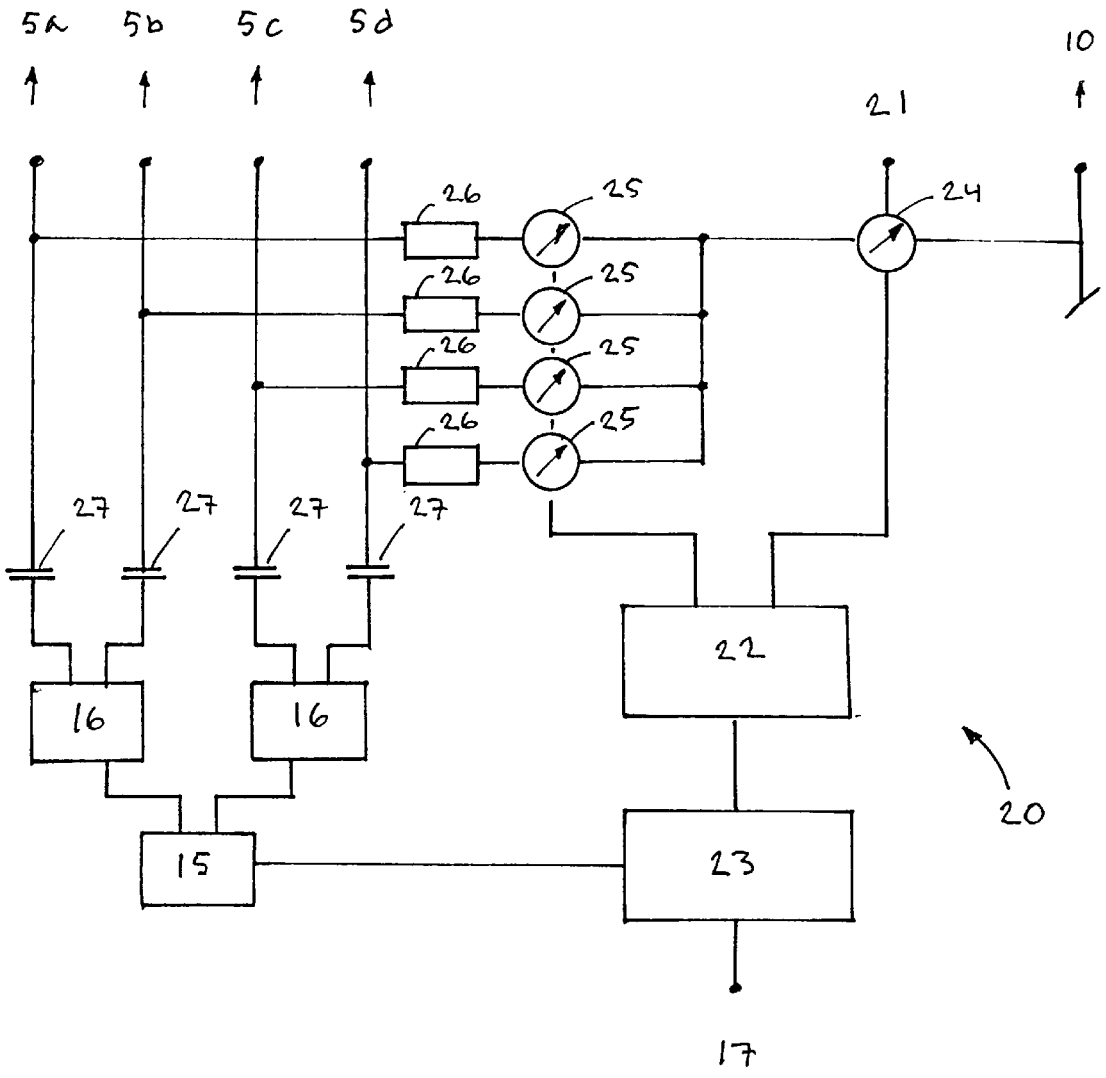
FIG. 11 shows a third interface circuit for feeding a four arm spiral aerial.

The above aerial may be fed with individual bias voltages as shown in FIG. 11.

The third interface circuit 20 shown in FIG. 11 comprises balun 15, for converting a single signal into two signals with a phase difference of 180° between them and two hybrid circuits, each providing a phase lag of 90°. Thereby, a four terminal interface circuit has been accomplished having a phase spread of 0°, 90°, 180° and 270°, respectively.

The control unit controls via four second bias voltage regulators 25 the bias voltage of each individual spiral arm 3*a* –3*d*.

The bias voltage may for instance be varied in such a manner, that the DC-bias voltage for each individual arm of a pair of opposing arms is respectively increased and respectively decreased, thereby changing the axial ratio of the polarity in a given direction.

FURTHER EMBODIMENTS OF THE INVENTION

The present invention would not only be restricted to two and four arm designs, but designs involving a single arm, three arms or any other number of arms are possible embodiments of the invention.

Likewise, the individual embodiments of the aerial set forth above may also form the individual elements in a group antenna whereby sub-groups of one or more individual elements are controlled according to desired directivity characteristics, by controlling the bias voltage for the individual subgroups.

Generally, the number of arms that are used in the spirals depend on the pattern requirements and the applications.

Regarding the shape of the spiral arms, the most desirable types are logarithmic and Archimedes spirals (cf. FIGS. 2, 5 and 8) with various numbers of turns, tilt-angles and linewidths. Advantageously, the spirals may be designed with self-complementary linewidths to keep the impedance constant, as is the case for the spiral shown in FIG. 12.

The feed circuits should be designed and matched according to the type of spirals that are used and according to the required directivity pattern. As shown above, the spirals may be fed at the centre but they can also be fed from the edge.

It should be understood that combinations of the above options and embodiments would fall under the scope of the invention as set out in the appended claims.

REFERENCE SIGNS

1 aerial
2 ferro-electric member
3 spiral
3*a* first spiral arm
3*b* second spiral arm
3*c* third spiral arm
3*d* fourth spiral arm
4 reflecting member
5 strip network
5*a* first strip
5*b* second strip
6 vias
6*a* first via
6*b* second via
7 transformer structure
8 front member
10 terminal of reflecting member
12 aperture
14 laminate
15 balun
16 hybrid circuit
17 signal input/output
18 first interface circuit
19 second interface circuit
20 third interface circuit
21 DC source
22 control unit
23 transceiver
24 first DC regulator
25 second DC regulator
26 inductor
27 capacitor

What is claimed is:

1. An antenna having at least one plane spiral arm being provided in front of and parallel with a plane face of a reflecting member, comprising:

a ferro-electric member being provided between the spiral arm and the reflecting member, whereby the antenna is adapted for receiving an adjustable bias voltage over the at least one arm and the reflecting member for varying the dielectric constant of, and thereby the delay through, the ferro-electric member such that the phase of a wave being reflected by the reflecting member is controlled to be in phase with a direct wave being received on or emitted from the at least one spiral arm.

2. The antenna according to claim 1 comprising:

a strip network being arranged at a distance from the reflecting member at the side of the reflecting member opposite the at least one spiral arm, the strip network comprising strips being provided with a terminal in one end and a connecting via in the other end, the via passing through an aperture in the reflecting member without contacting the reflecting member and being connected to a respective spiral arm.

3. The antenna according to claim 2, wherein the via extends from an end of a spiral arm at the center of the spiral.

4. The antenna according to claim 2, wherein the via extends from an end of a spiral arm at the perimeter of the spiral.

5. The antenna according to claim 1, wherein a dielectric laminate is provided between the reflecting member and the strip network.

6. The antenna according to claim 1, whereby a cone or cup shaped front member is arranged in front of the at least one spiral arm at the side opposite the ferro-electric member.

7. The antenna according to claim 6, wherein a transformer structure is arranged on top of the front member, the transformer structure having gradually decreasing dielectric properties.

8. The antenna according to claim 1 comprising an interface circuit having an adjustable DC bias voltage regulator whereby one pole thereof is coupled to the at least one spiral arm, the other pole being connected to the reflecting member.

9. The antenna according to claim 8, the interface circuit being adapted to be coupled to an aerial having at least two arms, the interface circuit comprising at least one balun having respective balanced ports being connected to respective arms.

10. The antenna according to claim 1, having two or more arms, comprising an interface circuit having individually adjustable DC bias voltage regulators feeding the individual arms.

11. The antenna according to claim 10, wherein the control of the individual bias voltages is used to control the axial ratio of the elipsoidically polarized field of the spiral arms according to a given aspect angle.

12. The antenna according to claim 10, wherein the control of the individual bias voltages is used to control the impedance match to a transceiver.

* * * * *